US006514548B2

(12) United States Patent
Lin

(10) Patent No.: US 6,514,548 B2
(45) Date of Patent: Feb. 4, 2003

(54) SHRIMP AND TRAY COMBINATION AND METHOD OF MAKING SAME

(75) Inventor: Duke Lin, Rancho Palos Verdes, CA (US)

(73) Assignee: Ocean Duke Corporation, Torrance, CA (US)

( * ) Notice: Subject to any disclaimer, the term of this patent is extended or adjusted under 35 U.S.C. 154(b) by 0 days.

(21) Appl. No.: 09/750,803

(22) Filed: Jan. 2, 2001

(65) Prior Publication Data

US 2002/0086095 A1 Jul. 4, 2002

(51) Int. Cl.[7] ..... B65D 85/00; B65D 81/00; A22C 25/00

(52) U.S. Cl. ..... 426/115; 426/120; 426/124; 426/129; 426/394; 206/541

(58) Field of Search ..... 426/115, 120, 426/124, 129, 394; 206/541

(56) References Cited

U.S. PATENT DOCUMENTS

D364,090 S * 11/1995 Krupa ..... D5/6
D396,606 S * 8/1998 Blazevich ..... D1/102
D404,612 S * 1/1999 Blazevich ..... D7/505
5,869,120 A * 2/1999 Blazevich ..... 426/112
D411,709 S * 6/1999 Curtis et al. ..... D7/387
D420,285 S * 2/2000 Sagan et al. ..... D12/171
6,021,903 A * 2/2000 Hanson ..... 206/541
6,022,571 A * 2/2000 Blazevich ..... 426/112
6,042,856 A * 3/2000 Sagan et al. ..... 206/465
D422,907 S * 4/2000 Sagan et al. ..... D9/425
6,168,813 B1 * 1/2001 Blazevich ..... 426/106

* cited by examiner

*Primary Examiner*—Nina Bhat
(74) *Attorney, Agent, or Firm*—Kelly Bauersfeld Lowry & Kelley, LLP

(57) ABSTRACT

A shrimp and tray combination includes a shrimp tray having an outer retaining ridge and an inner support ridge. A groove is formed between the inner and outer ridges. A plurality of shrimp is arranged radially on the tray with head ends of the shrimp lying in and supported in the groove and convex sides of the shrimp bodies supported on the inner support ridge. A cup and cover contain sauce for the shrimp. The cup and cover are located in a depression formed in the center of the tray with the tail ends of the shrimp bodies held in place by the side of the cup. The combination including the shrimp tray, the shrimp bodies, the cup, the cover, and the sauce may be tightly enclosed in a plastic film material as by shrink wrapping and frozen together for storage and shipment.

13 Claims, 4 Drawing Sheets

SHRIMP AND TRAY COMBINATION AND METHOD OF MAKING SAME

BACKGROUND OF THE INVENTION

The invention relates generally to food and to methods for packaging, shipping, storing, and serving food. More specifically, the invention provides an improved frozen shrimp product and a method of making such a product.

Trays are presently used for packaging and serving frozen shrimp. One such tray is disclosed in U.S. Pat. No. Des. 404,612. This tray requires shrimp to be placed on their sides in multiple layers. One consequence is that the overlapping, layered shrimp can be difficult to remove individually from the tray. Each shrimp must be pried from the adjacent shrimp. Subsequent consumers cannot be assured that remaining shrimp have not been handled.

A second undesirable characteristic of prior art tray and shrimp combinations of this type is a top uneven surface. The combination of the tray with layered tapered shrimp forms an irregular upper surface. There is only a small center of the tray that can serve as a base for stacking similar trays with shrimp. Stacking and storing multiple trays of shrimp could, therefore, be unstable and difficult.

Another undesirable characteristic of some prior art products is a lack of structural support. The weight of the vertically stacked shrimp is predominantly placed on a tiered, horizontal surface that is raised above the base of the tray. The weight of the shrimp on this surface can deform or damage the tray. The inclined horizontal surface provides limited support when a radially inward force is applied by a wrapping or sealing process.

Accordingly, there is a need for a shrimp and tray combination that can be stacked and stored, has vertical and horizontal support, is free from the risk of damage, and facilitates convenient, visually appealing service.

SUMMARY OF THE INVENTION

The present invention is embodied in a novel shrimp and tray combination for use in packaging shrimp. The combination is designed to allow convenient, visually appealing service of shrimp. Additionally, the resulting configuration of shrimp with the tray creates a strong unit that allows for stable and convenient stacking and storage.

In a preferred embodiment, a circular tray has outer and inner ridges that are elevated above the remaining areas of the tray. The inner ridge forms an arch to accommodate the radial placement of shrimp with the concave side of the shrimp lying on the ridge. A surface slopes radially inwardly and downwardly from the inner ridge to accommodate the shrimp. A cup for sauce or the like can rest in a depression at the center of the tray. In the preferred embodiment the head end of each shrimp rests on the surface of the tray abutting the outer ridge, and the tail rests at the bottom of a sloped surface leading to the cup. The shrimp are arranged radially around the inner ridge in a single layer, within close proximity of each other, with the concave side down.

One advantageous feature is the radial arrangement of shrimp around the inner ridge. The bodies of the shrimp can form a level, annular surface. The head and tail of each shrimp can rest on the bottom of the tray and abut the wall of either the tray or the cup. The shrimp thus conform to the tray and create a partially flat surface on which trays may be securely stacked. The frozen shrimp form an annular arch and thus provide a strong, supporting surface. This arrangement also creates a visually appealing display from which the shrimp may be individually removed without difficulty.

Other features and advantages of the present invention will become apparent from the following detailed description of the preferred embodiment, taken in conjunction with the accompanying drawings, which illustrate by way of example the principles of the invention.

BRIEF DESCRIPTION OF THE DRAWINGS

A preferred embodiment of the invention will be described below in connection with the accompanying drawings, in which.

DESCRIPTION OF THE PREFERRED EMBODIMENT

Figure 1:
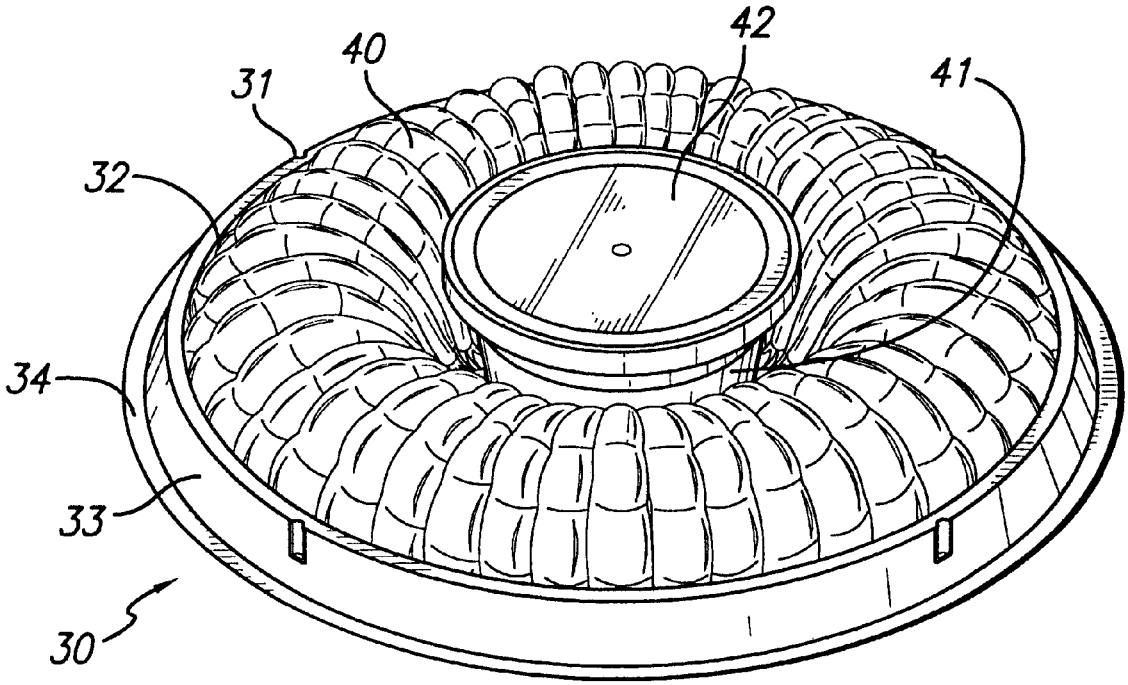
FIG. 1 is a perspective view of a preferred embodiment of the shrimp tray shown in FIG. 2 in combination with a plurality of shrimp.
Figure 2:
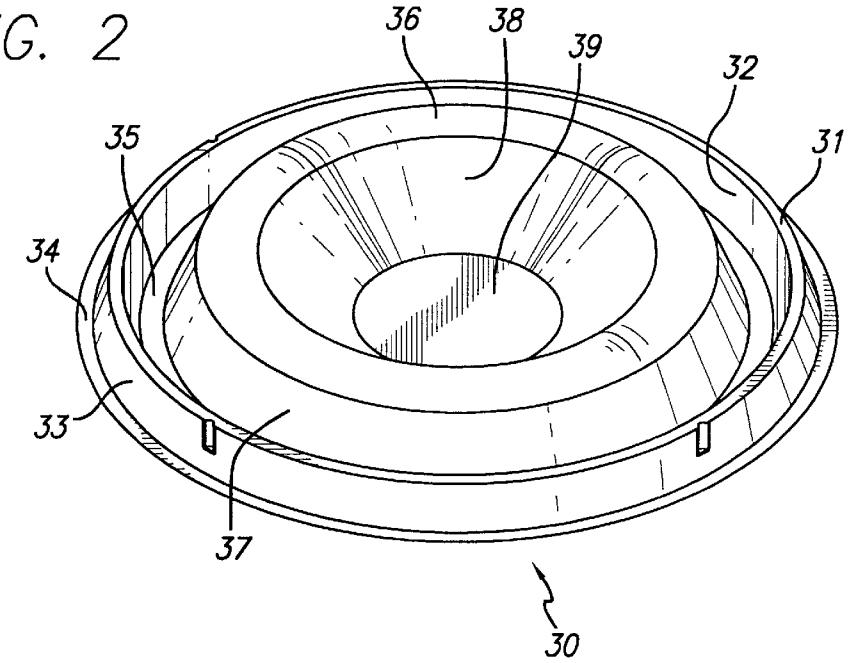
FIG. 2 is a perspective view of a preferred embodiment of a shrimp tray embodying a part of the present invention.

The invention includes a tray 30 for use in packaging, shipping, storing, and serving frozen shrimp. The tray 30 is preferably thermoformed from a single sheet of a suitable plastic and comprises a plurality of seamlessly joined annular, concentric and circular surfaces. The tray 30 is preferably molded from plastic. It should be made of a sufficiently rigid plastic by thermoforming, or by any other suitable method of manufacture. The top surface of the tray is configured to accommodate shrimp arranged radially to form an annular arch, as shown in FIG. 1, with the concave sides of the curved shrimp facing downward and supported on a surface of the tray.

Referring now primarily to FIGS. 1–5, the tray 30 is of generally circular configuration and includes an annular outer ridge 31 having an inner wall 32 and an outer wall 33. The tray can have an annular outer lip 34 extending horizontally from the outer wall. An annular bottom surface 35 extends inward from the inner wall defining the bottom of a groove. This bottom surface is preferably an annular flat surface to distribute the load over a supporting surface below (not shown).

A rounded support ridge 36 is formed by a raised annular wall 37 and a sloped surface 38 that extends downwardly at an appropriate angle toward the center 39 of the tray 30. The base of the raised wall extends from the flat surface 35. The support ridge 36 extends from the top of the nearly vertical raised wall and merges with the sloped surface. The sloped surface can be either straight or curved in cross section to accommodate the shape and size of the particular shrimp to be used with the tray 30. The annular outer ridge 31, the annular flat surface 35, the raised annular wall 37, the support ridge 36, the sloped surface 38, and the center 39 are all concentric.

When shrimp 40 are placed on the tray, the annular ridge 31 will serve as a retainer for the shrimp, with the inner ridge 36 and sloped surface 38 providing a support surface for the shrimp 40 and serving to position the shrimp on the tray 30, as described in more detail below.

The disk-like center 39 of the tray is flat and circular, extending inward from the base of the sloped surface 38. The center 39 is substantially co-planar with the annular flat surface 35 and the lip 34.

A separately formed flat circular base insert 43 is secured to the bottom of the tray 30. The base insert 43 may be made of heavy paper or card stock and can have consumer information and labeling printed on it. Thus, the base insert 43 serves as a flat and stable bottom surface for the tray 30, but it will be understood that the base insert can be omitted. Because the center, the annular flat surface, and the lip are all substantially or nearly level with one another, i.e., falling in a single plane, these elements will all bear against the base insert or supporting horizontal surface when the tray 30 is stacked or otherwise subject to a vertical load.

Figure 3:
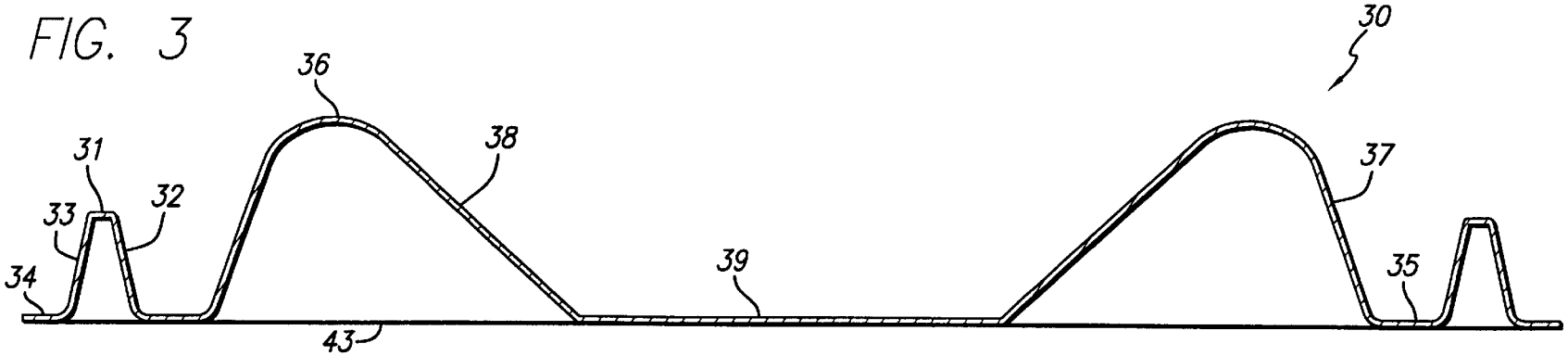
FIG. 3 is a sectional view of the shrimp tray shown in FIG. 2.
Figure 4:
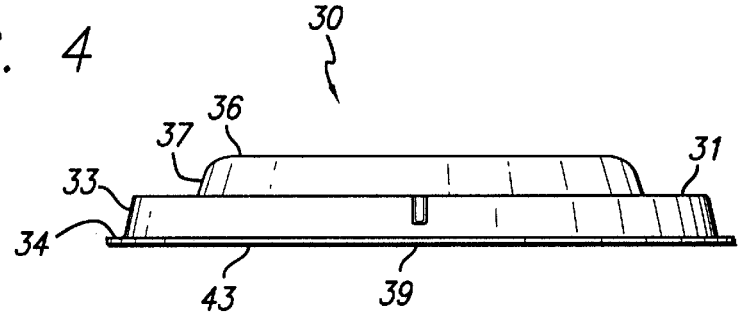
FIG. 4 is a side view of the shrimp tray shown in FIG. 2.
Figure 5:
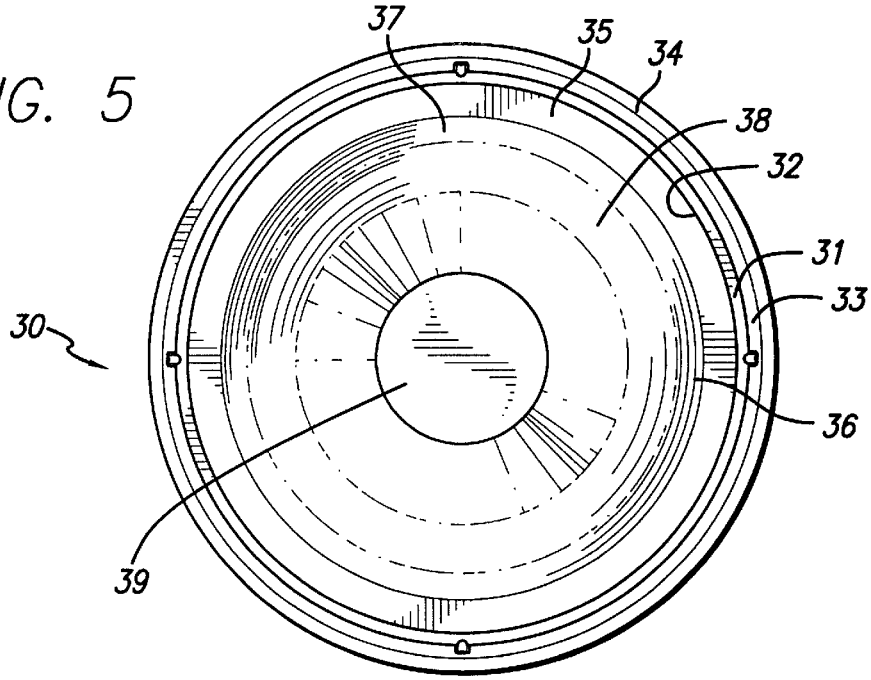
FIG. 5 is a top view of the shrimp tray shown in FIG. 2.
Figure 6:
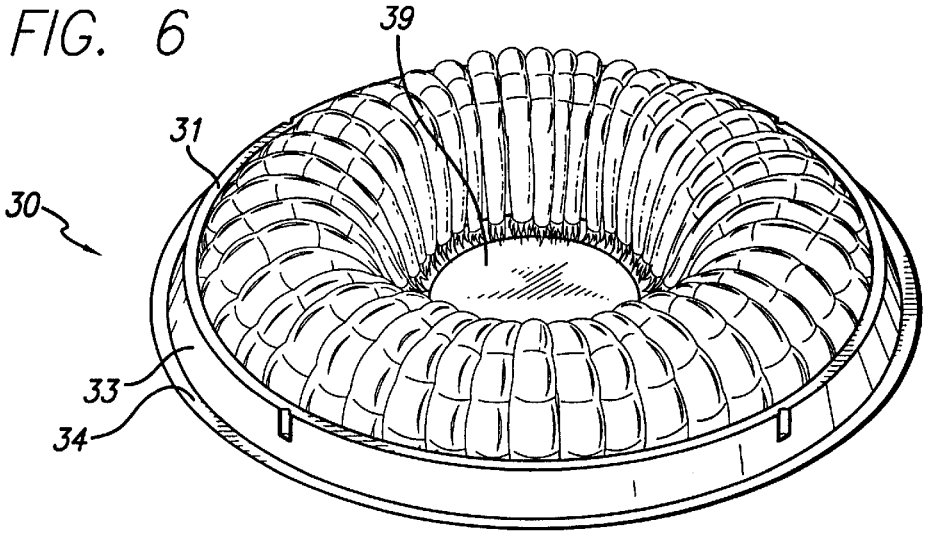
FIG. 6 is a perspective view of the shrimp and tray combination shown in FIG. 1 without the cup and cover.

Referring now primarily to FIG. 6, a plurality of shrimp 40 are frozen and arranged radially, tails inward, on top of the tray 30 with the concave side of each shrimp resting on top of the support ridge 36 (compare FIGS. 3 and 6). The arch of each shrimp is supported and the shrimp is then positioned by the support ridge 36. The tails are located adjacent the center 39 and the wider heads are adjacent to the flat surface 35, abutting the inner wall 32 of the outer ridge 31. The tail end of each shrimp body thus lies adjacent to the sloped surface 38. Radial movement of the shrimp is thus restrained or prevented. The optimum radial width of the tray 30 and the radial width of each of the annular surfaces varies depending on the size of the shrimp 40 intended for use with the tray. A representative tray 30 may hold 36–44 medium-sized frozen shrimp.

Figure 7:
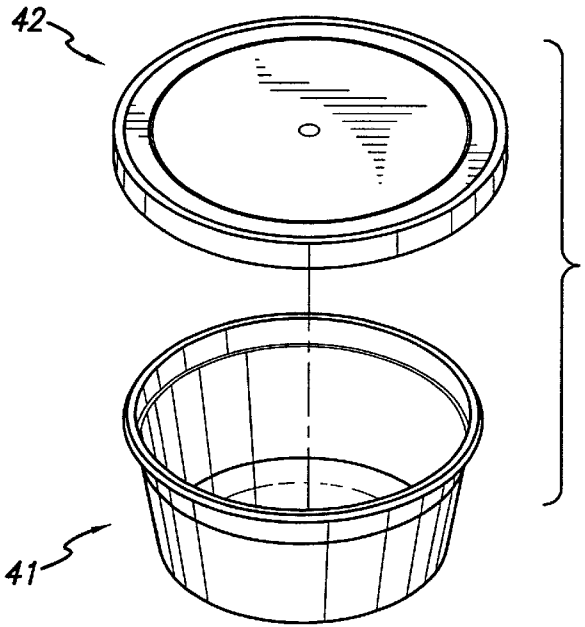
FIG. 7 is a perspective view of a cup and cover for use in the combination.
Figure 8:
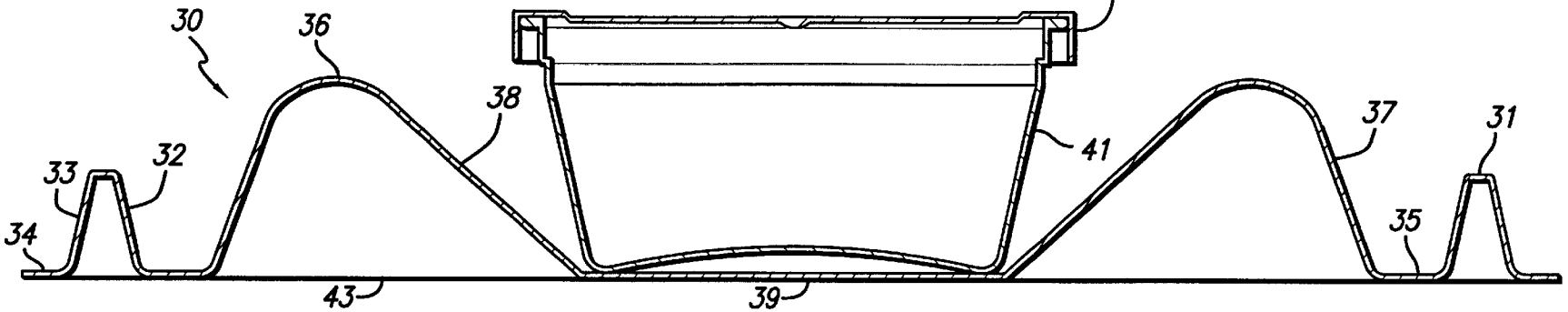
FIG. 8 is a sectional view of the tray shown in FIG. 2 with the cup and cover shown in FIG. 7.

Referring now especially to FIGS. 7 and 8, a cup 41 and a detachably connected cover 42, which may be a rigid plastic lid, are included and placed at the center of the tray 30 where it resides in the depression formed by the sloping surface 38 and the disk-like center or bottom 39. A combination comprising the tray 30, the shrimp 40, the cup 41 and the cover 42, is shown in FIG. 1. When so assembled, the tail of each shrimp abuts the cup 41 located at the center 39 of the tray 30. With the head of each shrimp between the inner wall 32 and the raised wall 37 and the tail of the shrimp abutting the cup, the annular surfaces of the tray and the cup interact with the frozen shrimp 40 to oppose any radially inward force applied to the outer wall 33 or lip 34 of the tray. Such radially inward or compression forces can, for example, be encountered in a shrink wrap, or other sealing process, or during packing or shipping. The strength thus provided reduces the risk of damage or deformation of the product.

The cup 41 can be filled with sauce for dipping the shrimp, and the tray 30, cup, cover 42, and shrimp 40 can be assembled, shrink-wrapped and frozen together. The rigidness of the frozen shrimp, supported by flat surface 35, support ridge 36, sloped surface 38, and center 39 of the tray, provides a firm annular surface on which multiple trays can be stacked, as described below.

When the shrimp 40 and tray 30 combination depicted in FIG. 1 is thawed and unwrapped for serving, the shrimp are easily accessible to a consumer. The shrimp 40 are arranged radially in a single layer. The entire convex side of each shrimp 40 is exposed when arched over the support ridge 36. An individual shrimp 40 can be easily removed without disturbing the remaining shrimp. Additionally, the annular arched arrangement of the shrimp 40 provides a visually appealing presentation for service.

The shrimp 40 are held securely on the tray 30 by the configuration of the tray acting in concert with that of the shrimp. When the tray 30 and shrimp 40 are assembled as shown in FIG. 1, the head ends of the shrimp are situated within the groove between the outer ridge 31 and the wall 37, and the head ends of the shrimp are supported from below by the of flat surface 35. The outer ridge thereby acts as a retainer preventing excessive movement of the shrimp 40 in a direction radially outward from the center of the tray.

The preferred embodiment has the advantage of improved vertical support over prior art trays. Together, the raised wall 37, the support ridge 36, and the sloped surface 38 form a strong continuous annular arch supported at the radially outward side by the flat surface 35 and at the radially inward side by the center 39. Supported by the base of the tray, the continuous arch becomes a firmly supported annular surface. Each shrimp lies across the continuous arch with the head adjacent to the flat surface 35 and the tail adjacent to the center. The weight of the shrimp 40 rests on the base of the tray 30 and the supported continuous arch having substantial strength in the vertical direction. Weight is not placed on unsupported surfaces and the tray 30 is less likely to be damaged by the weight of the shrimp 40 or from stacking multiple trays, as discussed below.

When frozen, the shrimp 40 can be a primary source of vertical support. The heads and tails of the shrimp rest at the flat surface 35 and center 39, respectively. Since the flat surface and center are nearly level with each other, the shrimp 40 are well supported by the base of the tray. Because they are frozen, the shrimp 40 form an arched, annular surface that is primarily supported by the flat surface and center of the tray 30. Therefore, it is not necessary that the support ridge 36 be extremely thick or strong.

The preferred embodiment also has improved horizontal strength. The flat surface 35, the center 39, and the base of the outer wall 33 form three nearly level surfaces connected by other annular surfaces. When a radially inward force is applied to the tray 30, as in a vacuum, shrink wrap or another sealing process, these three co-planar surfaces can exert force on each other to provide horizontal strength for the tray. This horizontal strength can exist with or without the lip 34 around the outer wall 33.

Another advantage of the invention resides in the method by which the shrimp 40 and tray 30 combination produces a strengthened product. As described above, the head of each shrimp lies on the flat surface 35 and occupies the space between the inner wall 32 and the raised wall 37. Bearing against the raised wall 37, the support ridge 36, and the sloped surface 38, the shrimp add support to these surfaces.

The ability to stack multiple shrimp and tray combinations is a further structural advantage. The figures depict a shrimp tray that includes a cup 41 and a detachably connected cover 42. When the shrimp 40 are radially arranged on the tray 30 as described herein, the annular shrimp surface formed by the outside of the shrimp bodies is substantially or nearly level with the cover 42 of the cup 41 (see FIG. 1). When multiple trays of shrimp 40 are stacked, the bottom of the tray 30, and in particular the flat base insert 43, rests firmly on top of the cover 42 and the shrimp bodies—with shrink wrap between them and protecting the shrimp. These extended, substantially flat support surfaces provide strength and stability when the shrimp and tray combinations are stacked.

While the particular embodiment described herein provides for one annular arrangement of shrimp, the invention can be used as well with multiple concentric annular arrangements of shrimp. A representative shrimp and tray combination embodying the invention has been described herein and depicted in the accompanying drawings. Modifications and additions to this tray may be incorporated as well by those of skill in the art. The scope of the invention should not be limited to the representative embodiment described herein. Instead, the scope of the invention should be determined primarily by reference to the appended claims, along with the full scope of equivalents to which those claims are legally entitled.

I claim:

1. A shrimp and tray combination, comprising:

a tray formed of a single sheet of plastic having an annular support ridge concentric with an outer edge and a sloping surface extending from a top of the support ridge to a depression formed in the center thereof having a generally flat base to hold a sauce cup, and outer ridge concentrically surrounding the support ridge and a groove between the outer ridge and the support ridge, wherein the groove and base form bottom surfaces of the tray that lie generally co-planar with one another; and a plurality of frozen shrimp arranged with their tails radially inward of their heads so as to form an annular arch with the shrimp being positioned so that the concave sides of the shrimp fit over and engage the support ridge.

2. The combination of claim 1, and further comprising a detachable sauce cup positioned in the depression.

3. The combination of claim 2, and further comprising a cover on the sauce cup.

4. The combination of claim 2, including a wrapping film covering the tray, shrimp and sauce cup.

5. The combination of claim 1, wherein the sloping surface is smooth.

6. The combination of claim 1, including an outer lip extending horizontally from the outer ridge and lying generally co-planar with the groove and base.

7. The combination of claim 1, including a flat base insert attached to the base and groove.

8. A shrimp and tray assembly, comprising:

a shrimp tray having an annular ridge with an inner wall and an outer wall, an annular lip extending outward from the outer wall, a groove including an annular bottom surface extending from the base of the inner wall, an annular raised wall extending upward from the bottom surface, an annular support ridge extending inward from the raised wall, an annular downward smooth sloped surface extending inward from the support ridge, a circular center extending inward from the downward sloped surface and defining a depression having a generally flat base, the annular lip, bottom surface of the groove and flat base of the center depression lying generally co-planar with one another;

a circular cup located proximate to the center of the shrimp tray;

a circular cover detachably connected to the cup;

a quantity of sauce contained within the cup and the cover;

a plurality of frozen shrimp, each shrimp having a head end and a tail end, an outer convex side, and an inner concave side; and a wrapping film tightly enclosing and holding the shrimp tray, the plurality of shrimp, the cup, the lid, and the sauce;

wherein each of the plurality of shrimp is arranged radially with its inner concave side positioned over the support ridge so that the plurality of shrimp are arranged in a single layer, the convex side of each of the plurality of shrimp form a nearly arch-shaped ring; and wherein the distance from the inner wall to the center corresponds approximately to the length of the shrimp such that the shrimp head end rests proximate to the inner wall and the bottom surface, and the tail end rests proximate to the cup.

9. A shrimp and tray combination, comprising:

a tray formed of a single sheet of plastic having an annular support ridge concentric with an outer edge and a smooth sloping surface extending from a top of the support ridge to a depression formed in the center thereof having a generally flat base to hold a sauce cup, and an outer ridge concentrically surrounding the support ridge and a groove between the outer ridge and the support ridge, and a lip extending from the outer ridge, wherein the groove, lip and base form bottom surfaces of the tray that lie generally coplanar with one another; and a plurality of frozen shrimp arranged with their tails radially inward of their heads so as to form an annular arch with the shrimp being positioned so that the concave sides of the shrimp fit over and engage the support ridge and are prevented from radial outward movement by the outer ridge.

10. The combination of claim 9, including a flat base insert attached to the base and groove.

11. The combination of claim 10, including a detachable sauce cup position in the depression.

12. The combination of claim 11, further including a cover on the sauce cup.

13. The combination of claim 12, including a wrapping film covering the tray, the shrimp, and the sauce cup.

* * * * *